US005803791A

United States Patent [19]

Chiles

[11] Patent Number: 5,803,791

[45] Date of Patent: Sep. 8, 1998

[54] LAUNCHER AND POD COMBINATION, FOR DISPENSING MINIATURE FLYERS AT ALTITUDE

[76] Inventor: Daniel T. Chiles, 1972 S. Oak Grove, Springfield, Mo. 65804

[21] Appl. No.: 920,968

[22] Filed: Aug. 29, 1997

Related U.S. Application Data

[60] Provisional application No. 60/025,114, Aug. 30, 1996.

[51] Int. Cl.[6] ..... A63H 37/00

[52] U.S. Cl. ..... 446/475; 124/1

[58] Field of Search ..... 124/1, 16, 56, 124/71, 73; 446/475

[56] References Cited

U.S. PATENT DOCUMENTS

| | | | |
|---|---|---|---|
| 1,421,234 | 6/1922 | Houghton | 124/16 X |
| 2,345,173 | 3/1944 | Baggott | 446/192 |
| 2,756,737 | 7/1956 | Resch, Jr. | 124/62 |
| 2,945,583 | 7/1960 | Sire | 124/16 X |
| 5,015,211 | 5/1991 | Reveen | 446/475 |
| 5,149,290 | 9/1992 | Reveen | 446/475 |
| 5,403,225 | 4/1995 | Watkins | 446/475 |
| 5,512,003 | 4/1996 | Parker | 446/475 |

FOREIGN PATENT DOCUMENTS

| | | | |
|---|---|---|---|
| 112599 | 8/1900 | Germany | 446/475 |
| 634200 | 3/1950 | United Kingdom | 446/475 |

*Primary Examiner*—John A. Ricci
*Attorney, Agent, or Firm*—Jonathan A. Bay

[57] ABSTRACT

A launcher and pod combination for dispensing miniature flyers at altitude includes a pod, a launcher for non-explosively launching the pod, an optional tether connected between the launcher and pod to jerk the flight of the pod to an abrupt halt, and, miniature flyers contained in the pod before launch which are to be dispensed by the pod when jerked at the limit of the tether.

20 Claims, 4 Drawing Sheets

LAUNCHER AND POD COMBINATION, FOR DISPENSING MINIATURE FLYERS AT ALTITUDE

CROSS-REFERENCE TO PROVISIONAL APPLICATION

This application claims the benefit of U.S. Provisional Application Ser. No. 60/025,114, filed Aug. 30, 1996.

BACKGROUND AND SUMMARY OF THE INVENTION

The invention generally relates to amusement devices. A launcher and pod combination for dispensing miniature flyers at altitude, in accordance with the invention, preferably comprises (i) a pod, (ii) a launcher for launching the pod by non-explosive means, (iii) an optional tether connected between the launcher and pod to jerk the flight of the pod to an abrupt halt, and, (iv) miniature flyers to be dispensed by the pod when jerked at the limit of the tether.

The launcher and pod combination include a non-pyrotechnic launching motivator such as compressed gas to allow, unlike fireworks, its use safely in and among an audience crowd for the amusement of them. Also, the miniature flyers are given various shapes for chosen slow descents for soft, safe landings upon the audience crowd, the given shapes including shapes for gliding, drifting, fluttering, and helicoptering and so on.

The motive power for launching the pod is preferably supplied by compressed gas or coil springs and like non-pyrotechnic or -explosive means for safety. The launcher and pod combination can include artificial noise makers so that the overall effect is aurally and visually simulative of fireworks, yet without the danger.

The miniature flyers carried by the pod are preferably numerous. The flyers can be constructed from any suitable lightweight material as foam or paper and the like. Preferably the flyers are not powered, and simply return to ground by free fall. The flyers are given diverse configurations. Some flyers are configured for gliding for distance. Others are configured for helicoptering more or less directly down as still others are shaped for drifting or fluttering, or tumbling or spiraling down in a slow descent, such that translocation is predominantly achieved by the prevailing wind or eddy currents, if any.

The flyers are preferably given distinctive shapes such as, among other shapes, the shapes of birds, butterflies, flowers, mushrooms, maple-tree seeds, clover leafs, pterodactyls, airplanes, fighter planes, soar planes, spiral streamers and so on, for enhancing their amusement value.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 7 is an enlarged perspective view of the pod at generally the same moment as FIG. 6, wherein numerous miniature flyers of diverse shapes have been dispensed for free fall to ground; and, FIGS. 8*a* through 8*d* comprise a sequence of comparable perspective views of an alternate version of the launcher and pod combination for dispensing miniature flyers at altitude, this alternate version including a coil compression spring as supplying the motive power that launches the pod out of the launcher, wherein:

DETAILED DESCRIPTION OF THE INVENTION

Figure 1:
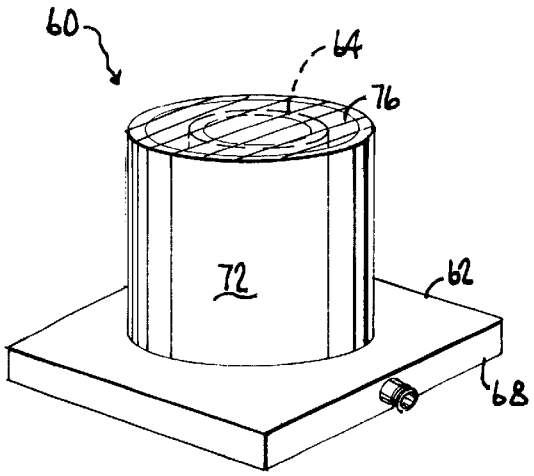
FIG. 1 is a perspective view of a launcher and pod combination for dispensing miniature flyers at altitude in accordance with the invention, wherein the pod is shown substantially enclosed in the launcher in a pre-launch position, the pod comprising a generally cup-shaped shell to hold numerous, diverse miniature flyers (not in view)

In FIG. 1, a launcher and pod combination 60 for dispensing miniature flyers (not shown, but see reference numerals 66*a*–66*f* in FIG. 7) at altitude in accordance with the invention, is shown in a pre-launch condition. The combination 10 includes the launcher 62 and pod 64. The launcher 62 comprises a base 68 and a tube 72 affixed upright to the base 68. The base 68 includes a fitting for connection to a supply of compressed gas, as will be explained below in reference to FIG. 3. The pod 64 generally comprises a cup-shaped shell (indicated by 74 in FIGS. 5 or 6) that is substantially nested in the launcher tube 72. The tube 72 has an upper open end that is covered by a diaphragm 76 that will be described more particularly below in connection with FIGS. 2 and 4.

Figure 2:
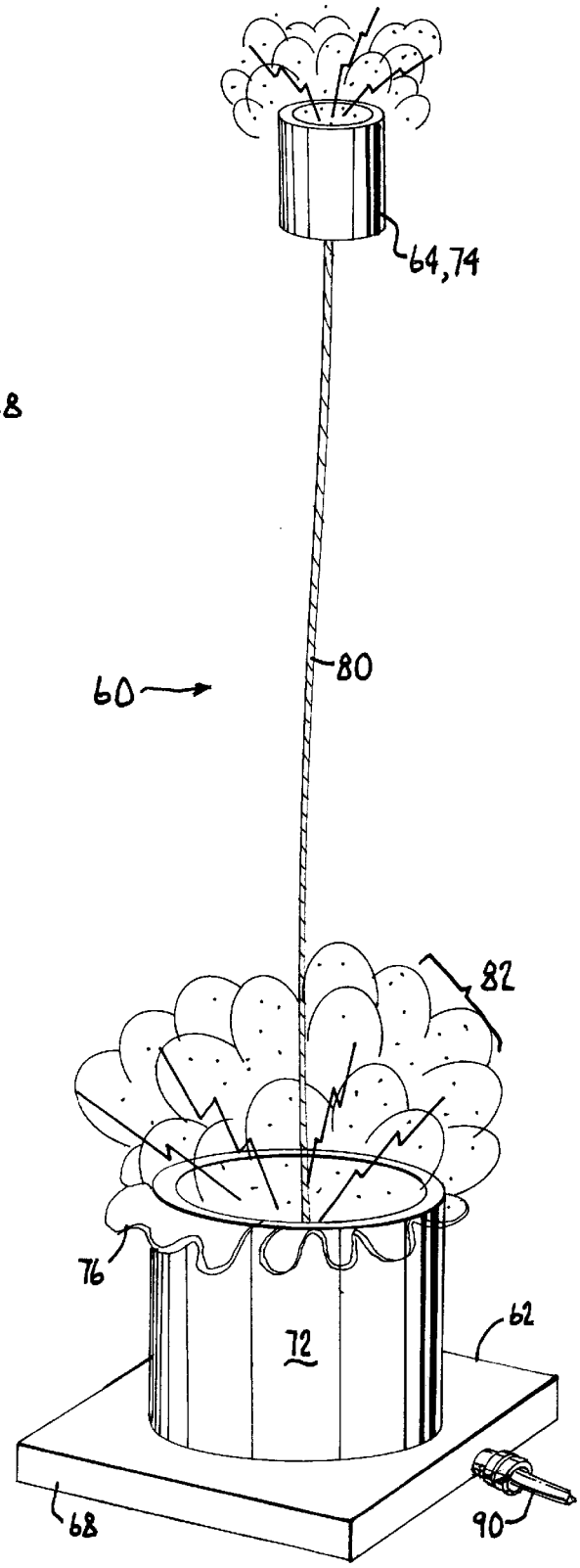
FIG. 2 is a perspective view comparable to FIG. 1 except showing a gas-propelled launch, the pod having reached its zenith as limited by a tether to the launcher, at which point the pod dispenses its contents at altitude, including powder and the miniature flyers (not shown)

FIG. 2 shows the results of a gas-propelled launch. The launcher 62 is connected to a supply of compressed gas via a flexible line 90. A sudden blast of compressed gas caused the pod 64 to be propelled with sufficient force from the launcher 62 to at least reach a given height, the limit of the pod 64's travel being determined by a tether 80 between the pod 64 and launcher 62. The tether 80 can be formed from any suitable limp but sufficiently non-stretchable light line or cord, including without limitation nylon or polymer fishing lines. The length of the tether 80 determines the zenith of the pod 64's flight, provided of course that the launcher 62 is supplied sufficient motive power to discharge the pod 64 at least the length of the tether 80.

Figure 4:
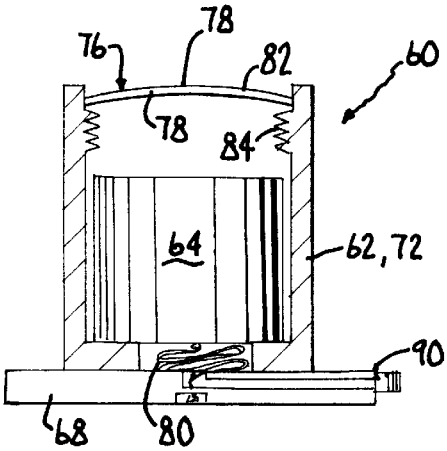
FIG. 4 is a partial section view of the launcher and pod combination of FIG. 1, taken through a vertical plane of symmetry.
Figure 8:
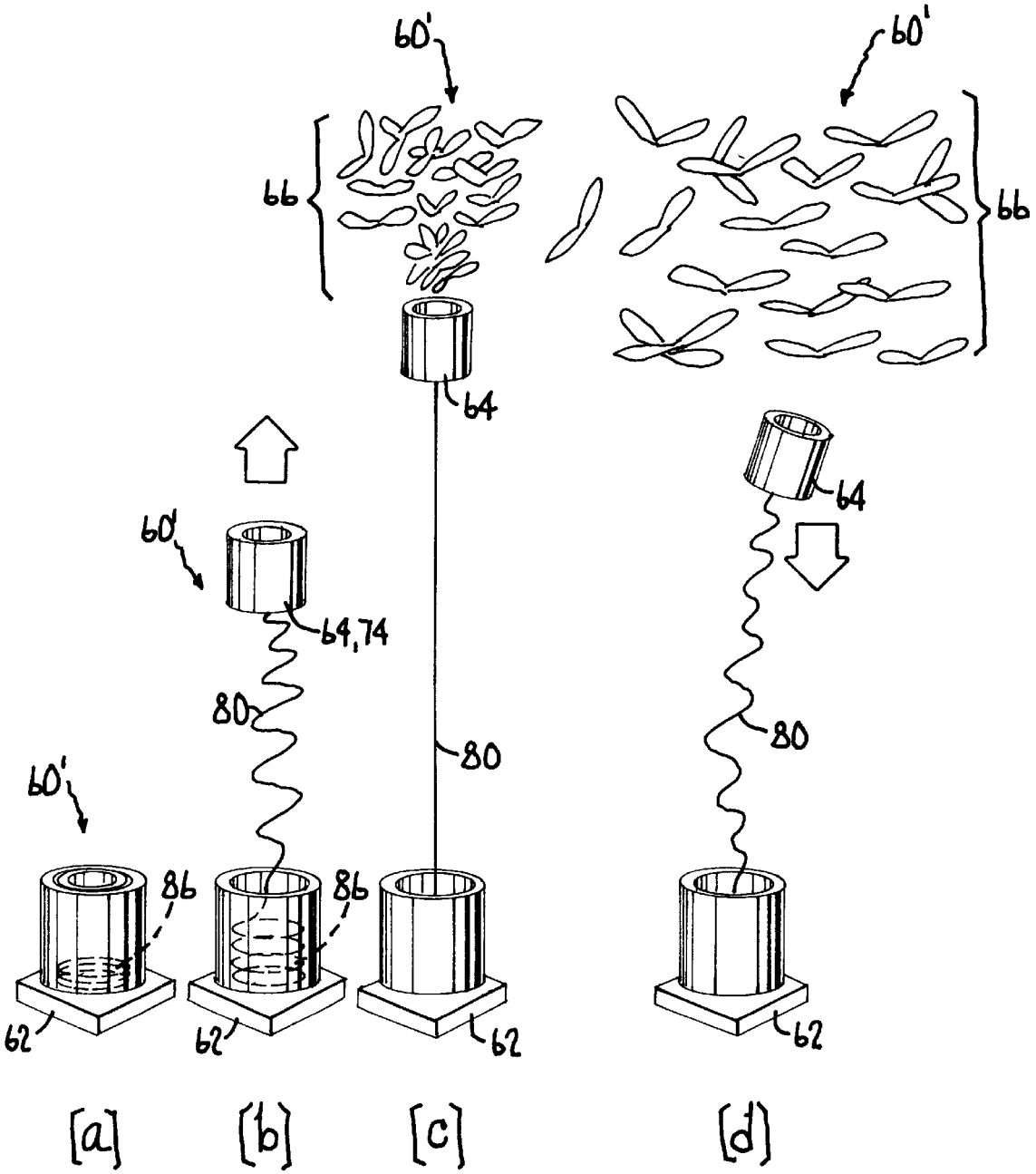
FIG. 8*a* shows the launcher and pod combination at rest in a pre-launch condition.
FIG. 8*b* shows the pod in the act of traveling up, with the tether uncoiling behind it.
FIG. 8*c* shows the pod at its zenith at which the miniature flyers are dispensed for free fall, and, FIG. 8*d* shows the pod rapidly falling back to ground as the miniature flyers variously glide, helicopter, flutter or otherwise drift down in a slow descent.

FIG. 4 is a section view of the launcher 62, with the pod 64 shown nested in the launcher 62 in the pre-launch condition of FIG. 1. The tether 80 rests in loose coils in preparation for uncoiling during launch (after which it will be stretched out in a generally straight line as shown by FIGS. 2 or 8*c*). FIG. 4 also shows the diaphragm 76 in an un-ruptured condition. The diaphragm 76 is a disk-shaped plastic envelope having upper and lower walls 78 of a thin polymer web enclosing therebetween a suitable powdery substance 82 such as talcum or corn starch and the like. As shown by FIG. 2, the purpose of the powder 82 is that, upon the rupture of the diaphragm 76, the powder 82 is expelled in all directions to artificially give visual simulation of an explosive blast as a gunpowder explosion or the like.

Additionally, the launcher and pod combination 60 are configured to create a noise upon launch so that, as was the purpose behind the powder 82, the audience for the launch is treated to a noise similar to that given by a gunpowder explosion. To do this, the launch tube 72 comprises a series of inwardly projecting rings 84 which, upon the passage of the pod 64 across the rings, create a rapid staccato noise. The noise can be enhanced by forming the outer cylindrical wall of the pod 64 with a like series of rings (not shown).

Figure 3:
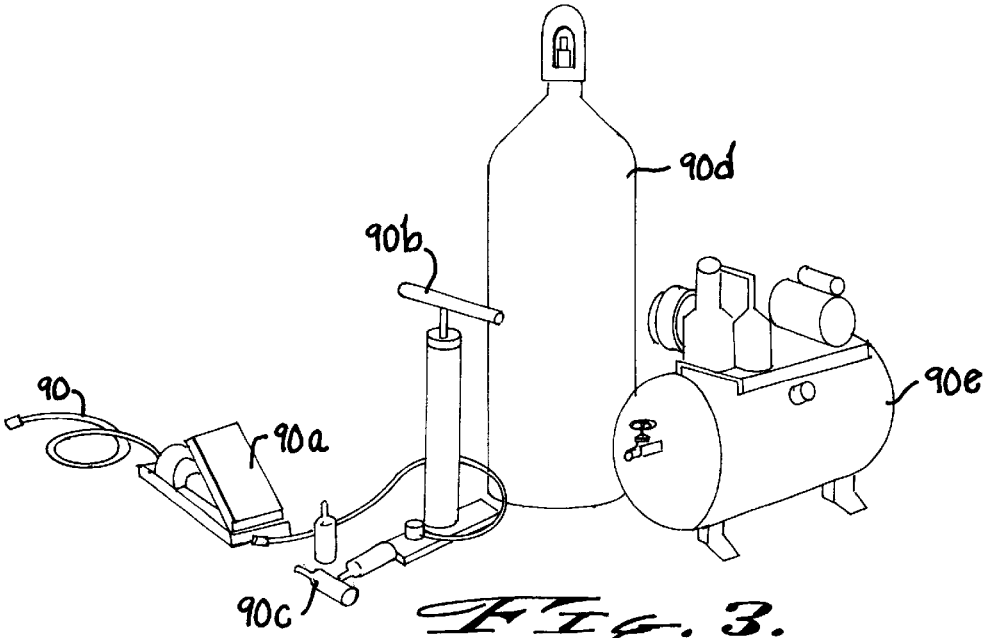
FIG. 3 is a perspective view of various alternate devices for supplying the launcher with a gas propellant in order to launch the pod by non-pyrotechnic or -explosive means.

FIG. 3 shows various alternate devices for supplying compressed gas to the launcher. These include without limitation a foot-operated pump 90*a*, a tire pump 90*b*, miniature cartridges of $CO_2$ 90*c*, a commercial air tank 90*d*, an air compressor 90*e*, and so on. The configuration of the actuator valve(s) (not shown) can be chosen from among any suitable and commercially available valve arrangements including, for example, the valve arrangement for $CO_2$ cartridges that is disclosed in U.S. Pat. No. 5,149,290—Reeven, the disclosure of which is fully incorporated herein by this reference.

The particular choice of any the devices 90*a*–90*e* for supplying compressed gas is dependent partly on the relative size or scale of the pod and launcher combination 60. It is an inventive aspect that the pod and launcher combination 60 in accordance with the invention can be scaled as desired for various use environments. For example, one preferred use environment for the launcher and pod combination 60 is an indoor environment, albeit with a ceiling height preferably between about 10 or 20 feet (3 to 6 m). The launcher 62, pod 64 and tether 80 are scaled accordingly. The propellant source would preferably be either the foot pump 90*a*, the tire pump 90*b*, or one or more $CO_2$ cartridges 90*c*. Alternatively, the motive force to launch the pod could be supplied by a coil compression spring, as shown by FIGS. 8*a* and 8*b* (the coil spring being indicated by reference numeral 86). The pod 64 is sent skyward comparably as a jack-in-the-box.

A launcher and pod combination 60 scaled as small as shown by FIGS. 8*a* through 8*d* would be suitable for play by children because of its relative harmlessness. Its suitability for indoor use aside, nothing in the construction of a FIGS. 8*a*–8*d* launcher and pod combination 60' would prevent its use outside, say in a back yard of the children users. But it is an inventive aspect of the small-scale launcher and pod combination 60' that such a small-scale version could be used indoors as well, if given a suitable indoor space.

At the other end of the spectrum, the launcher and pod combination 60 could be scaled for tether lengths of 50 to 200 feet or more (15 to 60 m), with the pod 64 sized for showering mass quantities of flyers 66 (see FIG. 7) over a large outdoor audience at such events as concerts, festivals, races and conventions as well as various other sport, game and/or amusement events. Large-scale versions of the launcher and pod combination 60 are preferably operated by professionals who can safely handle the compressed-gas equipment 90*d*–90*e* that would be needed to thrust a large-size pod 64 to the appropriate altitude. It is an inventive aspect of the large-version launcher and pod combination 60 that the audience would be treated to a sudden burst of colorful and fanciful flyers 66 which would slowly descend in graceful, arcing trajectories down into the audience. Those ones of the flyers 66 which fall into the audience would likely become souvenirs.

In view of the foregoing, the launcher and pod combination 60 in accordance with the invention can be scaled to various sizes, including without limitation the two foregoing examples just previously described, and so the depiction in the drawings of a non-specific size of launcher and pod combination in accordance with the invention does not limit the invention from being scaled appropriately for any given use environment.

Figure 5:
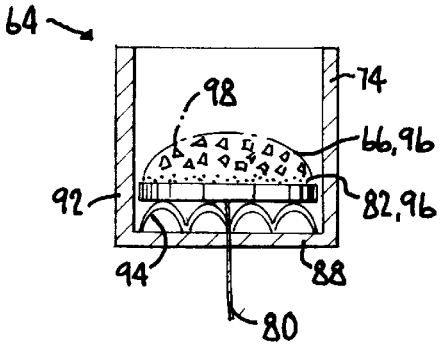
FIG. 5 is a vertical section view of the pod with its powder and miniature flyer contents at rest before they are dispensed at altitude, wherein portions of the miniature flyers are broken away.

FIG. 5 shows the pod 64 in a rest condition. The cup-shaped shell 74 of the pod 64 has a bottom wall 88 and a cylindrical side wall. The pod 64 further comprises a disk 92 inserted in the shell 74 and spaced off the bottom wall 88. The disk 92 is affixed to one end of the tether 80, wherein the tether 80 extends away to its opposite end that is affixed to the launcher 62 (e.g., see FIGS. 2 or 8*b*–8*d*) by extending through a hole in the center of the bottom wall of the shell 74. The disk 92 and bottom wall 88 enclose therebetween a layer of closed-cell material 94 like blister pack material used in shipping packaging. The disk 92 carries on its upper surface the dispensable contents 96 of the pod. The dispensable contents 96 include a relatively thin layer of powdery material 82 as talcum or corn starch and the like at rest directly upon the disk 92. The remaining volume of the pod 64 is filled with numerous miniature flyers 66 (only a portion of which are depicted, the other portions being removed from the view for clarity at the broken line 98 in FIG. 5). The flyers 66 are densely packed in the pod 64 to maximize the number of flyers 66 carried thereby and dispensed at altitude.

Figure 6:
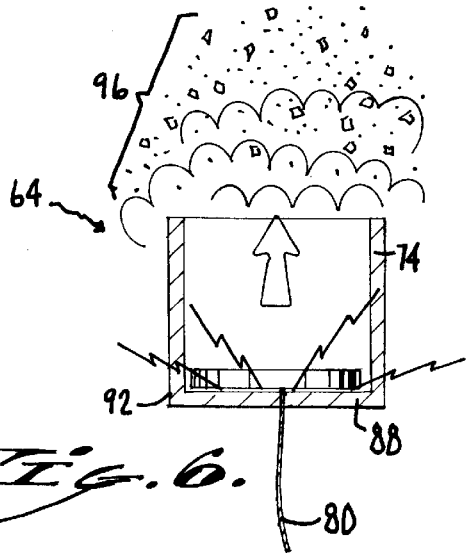
FIG. 6 is a section view comparable to FIG. 5 except showing the pod in the act of dispensing its contents at altitude.

FIG. 6 shows the changed position of the pod 64's components at the point in the pod 64's flight where the tether 80 has straightened to its limit. The tether 80 draws the disk 92 sharply against the bottom wall 88, which as a result crushes and ruptures the air cells 94. The rupturing air cells 94 give off a "pop" noise similar to the explosion of a small charge of gunpowder. The dispensable contents 96 are thrown clear. The powder 82 gives the artificial appearance of smoke from a gunpowder explosion. The flyers 66 are concurrently released for free fall back to ground.

Figure 7:
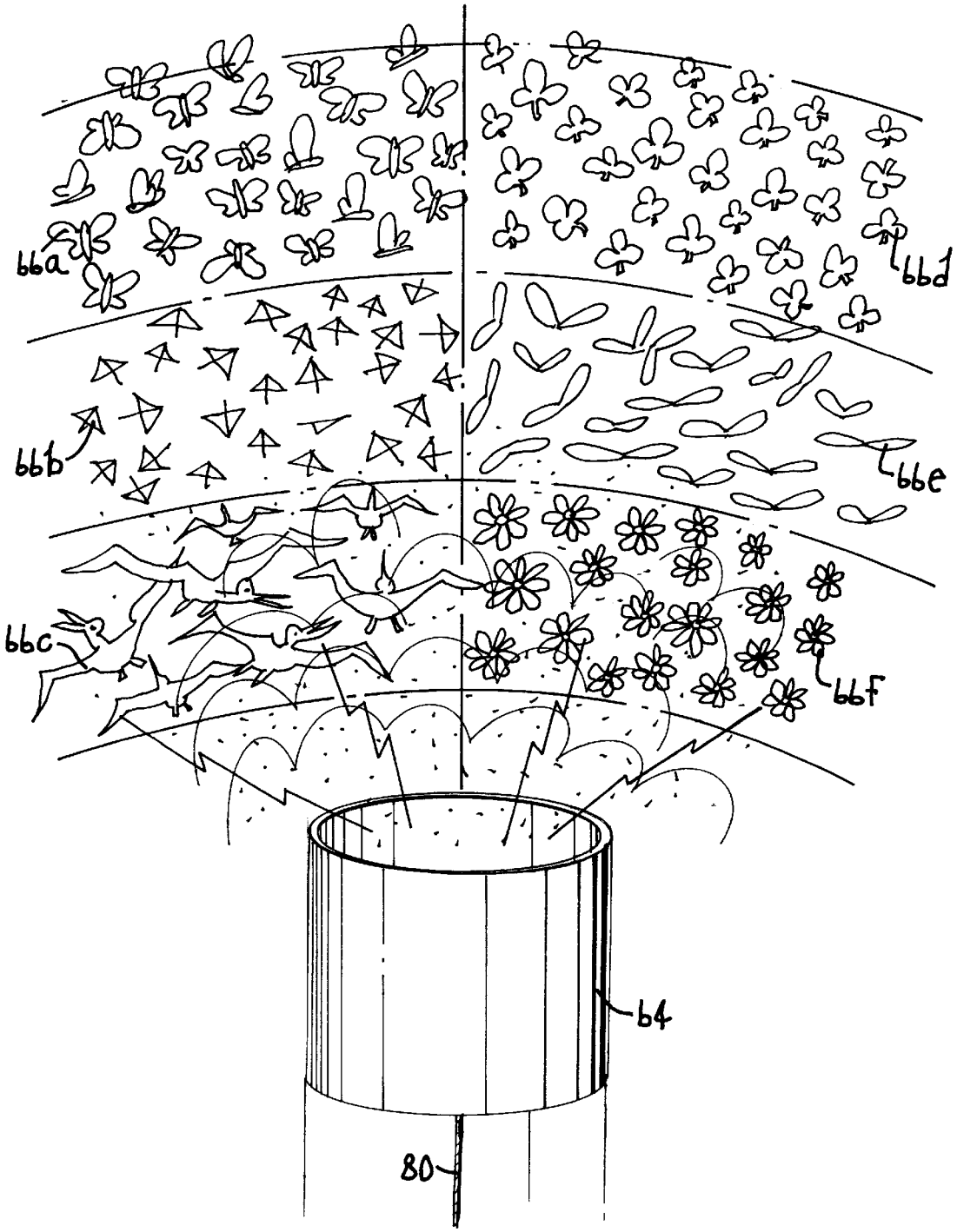

FIG. 7 shows a variety of the distinctive shapes that can be given to the flyers 66 to enhance their aesthetic and amusement value. These shapes include without limitation the shapes of butterflies 66*a*, delta-winged aircraft 66*b*, pterodactyls 66*c*, clover leafs 66*d*, soar planes 66*e*, and flowers 66*f*. Examples of other candidate shapes include without limitation the shapes of birds, maple-tree seeds, mushrooms, spiral streamers, and so on (not shown). There are various considerations that go into to the choice of an given shape. One consideration includes the probable trajectory that a given shape will take on its way down. The soar-planes 66*e* will presumably glide a further distance than the helicoptering flowers 66*f*, yet each is presumed to give a pleasing if not different trajectory for the audience. The delta-winged aircraft 66b will give speed.

Some shapes are chosen for their prospective souvenir value. For example, it is presumed that the pterodactyl and butterfly shapes 66*c* and 66*a* will be relatively popular souvenir keepsakes with the audience. Also, the pterodactyl and butterfly shapes 66*c* and 66*a* more naturally allow brilliant coloration that might look unnatural on a fighter-plane shape. And for a different reason altogether, the choice of clover-leaf shapes 66*d* may allow the hosts of the launch event to conduct a lottery via the flyers. That is, whoever in the audience collects and returns a four-leaf clover might be given a prize.

Other inventive aspects of the launcher and pod combination 60 include the following. It is basically reusable. The pod 64 is recoverable after launch. The depleted materials such as the powder 82 and the air cells 94 and the like can be replaced. For the relatively large-scale versions of the launcher and pod combination 60, the flyers 66*a*–66*f* would likely have to be replaced. However, for the relatively small-scale version 66' (e.g., FIGS. 8*a*–8*d*), most if not all of the flyers 66 can be recovered and reused.

FIGS. 8*a*–8*d* show in sequence a given launch of the launcher and pod combination 60' in accordance with the invention. FIG. 8*a* shows the launcher 62 with the pod (not in view) nested therein in a pre-launch condition. FIG. 8*b* shows the pod 64 immediately after launch and intermediate its zenith position (shown by FIG. 8*c*). Staying in FIG. 8*b*, the tether 80 is only partially uncoiled, and the dispensable contents 96 of the pod 64 remain at rest in the shell 74 of the pod 64.

FIG. 8*c* shows the pod 64 at its zenith. The tether 80 is stretched tight. It jerks the pod 64 to an abrupt halt. The flyers 66 (and any other dispensable contents 96, such as powder, if any) are dispensed with force because their own momentum carries them out of the pod 66. In FIG. 8*d*, the pod 64 is shown falling rapidly whereas, at the same time, the miniature flyers 66 variously glide, helicopter, flutter or otherwise drift down in a slow descent.

The launcher and pod combination 60 in accordance with the invention provides various advantages. It is a safe replacement for fireworks and it can provide comparable visual and aural amusement. It can be scaled to small sizes suitable for discharging from a residential lawn. It can also be scaled to large sizes for amuseing big audiences outdoors. Unlike fireworks, the launcher and pod combination 60, if appropriately scaled and arranged, (i) is suitable for indoor use, (ii) comprises substantially re-usable components, and, (iii) in consideration of the debris (i.e., the flyers) it releases at altitude, is optionally aimed over—rather than away from—the audience, in order to allow the flyers to shower down on them.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A non-pyrotechnic amusement device comprising:

a pod, a launcher for the pod including non-pyrotechnic launching means for launching the pod to altitude;

an altitude-limit tether connected between the launcher and the pod to jerk the flight of the pod to an abrupt halt at the limit of the tether; and, multiple miniature flyers contained in the pod before launch to be dispensed by the pod at altitude when jerked at the limit of the tether;

wherein the miniature flyers are given a shape for a chosen slow descent including by gliding, fluttering, drifting, and helicoptering.

2. The non-pyrotechnic amusement device of claim 1, wherein the miniature flyers are given distinctive shapes to enhance their amusement value including choices of butterflies, delta-winged aircraft, pterodactyls, clover leafs, soar planes, flowers, bird-shapes, maple-tree seeds, mushrooms, and spiral streamers.

3. The non-pyrotechnic amusement device of claim 1, wherein the launcher, pod, tether, and flyers allow re-use for successively repeating the launch event.

4. The non-pyrotechnic amusement device of claim 1, wherein the non-pyrotechnic launching means includes one of a foot-operated air pump, a tire pump, miniature cartridges of compressed gas, a commercial tank of compressed gas, and a gas compressor.

5. The non-pyrotechnic amusement device of claim 1, wherein the non-pyrotechnic launching means includes a coil compression spring.

6. The non-pyrotechnic amusement device of claim 1, wherein the tether rests in loose coils before use and extension between the launcher and pod, the tether allowing scaling according to launching power of the non-pyrotechnic launching means in given lengths chosen from ten (10), twenty (20), fifty (50), and two-hundred (200) feet.

7. The non-pyrotechnic amusement device of claim 1, wherein the launcher and pod further comprise a sound-making means for giving an audio enhancement to the launch event to recreate imaginatively or evoke a pyrotechnic blast of a launched firework.

8. The non-pyrotechnic amusement device of claim 7, wherein sound-making means comprises interfering ring formations on both the launcher and pod which as they clip each other during a launch event create a rapid staccato sound.

9. The non-pyrotechnic amusement device of claim 1, wherein the pod further comprises a report-making means for giving an audio enhancement to the event when the flyers are dispensed to recreate imaginatively or evoke a pyrotechnic report of a firework.

10. The non-pyrotechnic amusement device of claim 9, wherein report-making means comprises air cells which are ruptured at the abrupt halt of the pod at the limit of the tether, and consequently issue a pop sound.

11. The non-pyrotechnic amusement device of claim 1, wherein the pod further comprises a powder-releasing means for giving a visual enhancement to the event when the flyers are dispensed to recreate imaginatively or evoke a pyrotechnic smoke puff of a reporting firework.

12. A non-pyrotechnic launcher and pod combination for showering mass quantities of miniature flyers at altitude over an audience crowd for their amusement, the non-pyrotechnic launcher and pod combination comprising:

a pod;

a launcher for the pod including non-pyrotechnic launching means for launching the pod to altitude;

non-pyrotechnic dispensing means for dispensing the flyers from the pod after sufficient altitude has been reached; and, mass quantities of miniature flyers closely packed in the pod before launch to be dispensed from the pod at altitude by the non-pyrotechnic dispensing means;

wherein the miniature flyers are given various shapes for chosen slow descents for soft, safe landings upon the audience crowd, the given shapes including shapes for gliding, drifting, fluttering, and helicoptering.

13. The non-pyrotechnic launcher and pod combination of claim 12, wherein the miniature flyers are given distinctive shapes to enhance their amusement value including one of butterflies, delta-winged aircraft, pterodactyls, clover leafs, soar planes, flowers, bird-shapes, maple-tree seeds, mushrooms, and spiral streamers.

14. The non-pyrotechnic launcher and pod combination of claim 12, wherein the non-pyrotechnic launching means comprises a tether connected between the launcher and pod to jerk the flight of the pod to an abrupt halt at the limit of the tether.

15. The non-pyrotechnic launcher and pod combination of claim 14, wherein the tether allows scaling in given lengths chosen from generally between fifty (50) and two-hundred (200) feet.

16. The non-pyrotechnic launcher and pod combination of claim 12, wherein the non-pyrotechnic launching means includes one of a commercial tank of compressed gas and a gas compressor such that the launcher and pod combination can be re-used for successive repeats of the launch event.

17. The non-pyrotechnic launcher and pod combination of claim 12, wherein the launcher and pod further comprise a sound-making means for giving an audio enhancement to the launch event to recreate imaginatively or evoke a pyrotechnic blast of a launched firework.

18. The non-pyrotechnic launcher and pod combination of claim 17, wherein sound-making means comprises interfering ring formations on both the launcher and pod which as they clip each other during a launch event create a rapid staccato sound.

19. The non-pyrotechnic launcher and pod combination of claim 12, wherein the pod further comprises a report-making means for giving an audio enhancement to the event when the flyers are dispensed to recreate imaginatively or evoke a pyrotechnic report of a firework.

20. The non-pyrotechnic launcher and pod combination of claim 12, wherein the pod further comprises a powder-releasing means for giving a visual enhancement to the event when the flyers are dispensed to recreate imaginatively or evoke a pyrotechnic smoke puff of a reporting firework.

* * * * *